US008327740B2

(12) United States Patent
Rasmussen

(10) Patent No.: US 8,327,740 B2
(45) Date of Patent: Dec. 11, 2012

(54) TORQUE WRENCH, HANDLE AND HEAD PIECE

(75) Inventor: Henrik Hans Rasmussen, Kgs. Lyngby (DK)

(73) Assignee: Elos Pinol A/S, Gorlose (DK)

( * ) Notice: Subject to any disclaimer, the term of this patent is extended or adjusted under 35 U.S.C. 154(b) by 340 days.

(21) Appl. No.: 12/601,554

(22) PCT Filed: May 30, 2008

(86) PCT No.: PCT/EP2008/056703
§ 371 (c)(1), (2), (4) Date: Apr. 7, 2010

(87) PCT Pub. No.: WO2008/145734
PCT Pub. Date: Dec. 4, 2008

(65) Prior Publication Data

US 2010/0304330 A1 Dec. 2, 2010

(30) Foreign Application Priority Data

Jun. 1, 2007 (DK) ..... 2007 00803

(51) Int. Cl.
*B25B 23/142* (2006.01)

(52) U.S. Cl. ..... 81/467; 81/477

(58) Field of Classification Search ..... 81/467, 81/477, 478, 483
See application file for complete search history.

(56) References Cited

U.S. PATENT DOCUMENTS

| | | | | |
|---|---|---|---|---|
| 1,425,816 A | | 8/1922 | Van Horn | |
| 2,512,032 A | | 6/1945 | Mellert | |
| 2,686,446 A | | 8/1954 | Livermont | |
| 2,888,825 A | | 6/1959 | Krafft | |
| 2,934,946 A | | 5/1960 | Engquist | |
| 3,018,677 A | | 1/1962 | Mutolo et al. | |
| 3,587,307 A | | 6/1971 | Newberg | |
| 3,664,186 A | | 5/1972 | Kraus | |
| 3,967,513 A | | 7/1976 | Myrdal | |
| 4,015,335 A | | 4/1977 | Nash et al. | |
| 4,226,127 A | | 10/1980 | Hardiman | |
| 4,244,434 A | | 1/1981 | Wilson | |
| 4,488,442 A | | 12/1984 | Pacinelli | |
| 4,517,848 A | | 5/1985 | Faure | |
| 4,589,289 A | * | 5/1986 | Neuhaus | 73/862.23 |
| 4,805,464 A | | 2/1989 | Grabovac | |
| 4,827,813 A | | 5/1989 | Ruland | |
| 4,838,134 A | | 6/1989 | Ruland | |
| 5,129,823 A | | 7/1992 | Hughes | |

(Continued)

FOREIGN PATENT DOCUMENTS

| | | | |
|---|---|---|---|
| CN | 1469795 A | 1/2004 | |

(Continued)

*Primary Examiner* — David B Thomas
(74) *Attorney, Agent, or Firm* — Volentine & Whitt, PLLC

(57) ABSTRACT

The present invention relates to a handle, a head piece and a wrench, such as a torque wrench, in particular for use in surgery and prosthetics, such as surgery and prosthetics within the dental field. A handle for a wrench is provided, wherein the handle comprises an elongated body element extending along a first axis, and a torque arm for indicating the torque applied to the torque arm, the torque arm having a proximal end attached to the body element. Furthermore, the handle comprises a first locking element, the first locking element being adapted to removably engage with a locking element of a head piece, and the handle further comprises a ratchet element that is adapted to engage with a tool piece in a ratchet gear.

23 Claims, 8 Drawing Sheets

U.S. PATENT DOCUMENTS

Figure 1:
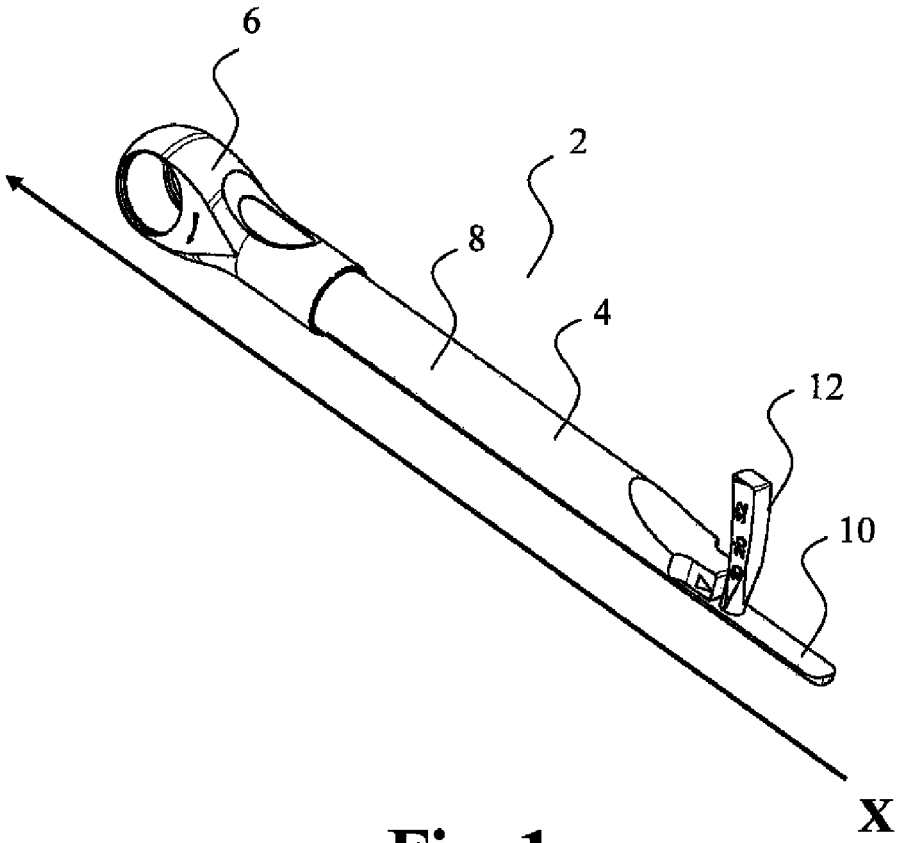

| | | | |
|---|---|---|---|
| 5,152,200 | A | 10/1992 | Kaplan |
| 5,295,831 | A | 3/1994 | Patterson et al. |
| 5,337,638 | A | 8/1994 | Coss et al. |
| 5,345,845 | A | 9/1994 | Myers |
| 5,351,583 | A | 10/1994 | Szymber et al. |
| 5,366,412 | A | 11/1994 | Beaty et al. |
| 5,368,480 | A | 11/1994 | Balfour et al. |
| 5,503,042 | A | 4/1996 | Larson et al. |
| 5,571,014 | A | 11/1996 | Gregory, Jr. et al. |
| 5,597,305 | A | 1/1997 | Ray, Sr. |
| 5,626,474 | A | 5/1997 | Kukla et al. |
| 5,725,533 | A | 3/1998 | Carlsson |
| 5,734,113 | A | 3/1998 | Vogt et al. |
| 6,007,336 | A | 12/1999 | Sapkos |
| 6,021,694 | A | 2/2000 | Beger |
| 6,109,150 | A | 8/2000 | Saccomanno, III |
| 6,162,053 | A | 12/2000 | Hollander |
| 6,990,877 | B1 * | 1/2006 | Wu ..... 81/467 |
| 7,597,032 | B2 | 10/2009 | Baumgartner |
| 2006/0123958 | A1 | 6/2006 | Jamnia et al. |

FOREIGN PATENT DOCUMENTS

| | | | |
|---|---|---|---|
| DE | 19507535 | A | 9/1996 |
| DE | 202004014195 | U1 | 11/2004 |
| DE | 202005012439 | U1 | 10/2005 |
| EP | 1384447 | A1 | 1/2004 |
| EP | 1655106 | A1 | 5/2006 |
| GB | 737944 | A | 10/1955 |
| GB | 781318 | A | 8/1957 |
| KR | 20040029512 | A | 4/2004 |
| SE | 116761 | C | 7/1946 |
| WO | 0222313 | A1 | 3/2002 |
| WO | 2006295542 | A1 | 3/2006 |

* cited by examiner

TORQUE WRENCH, HANDLE AND HEAD PIECE

CROSS REFERENCE TO RELATED APPLICATIONS

This application is the national phase under 35 U.S.C. 371 of PCT International Application No. PCT/EP2008/056703 which has an international filing date of May 30, 2008, and also claims priority under 35 U.S.C. 119 to Danish application PA 2007 00803 filed on Jun. 1, 2007, which applications are hereby incorporated by reference in their entirety for all purposes as if fully set forth herein.

The present invention relates to a handle, a head piece and a wrench, such as a torque wrench, in particular for use in surgery and prosthetics, such as surgery and prosthetics within the dental field.

Tools and devices used during surgery and surgical operations must be easy to clean due to the extensive hygiene requirements in an operating room. Known torque wrenches comprises a large number of small parts that need to be dismounted before and assembled after cleaning thereby making cleaning a tedious and difficult task.

Accordingly, it is an object of the present invention to provide a torque wrench that is easy to handle during assembly and disassembly.

It is a further object to provide a torque wrench with a ratchet function such that the torque wrench engages with a tool coupled to the torque wrench when rotating the torque wrench in one direction and disengages with the tool when rotating the torque wrench in the opposite direction.

Furthermore, it is an object of the present invention to provide a torque wrench that is easy to clean.

It is also an object of the invention to provide a torque wrench that can be used for different tools and that can be easily adjusted to tools with different shapes and measures.

Accordingly, a handle for a torque wrench is provided, comprising an elongated body element extending along a first axis, and a torque arm for indicating the torque applied to the torque arm, the torque arm having a proximal end attached to the body element. The handle further comprises a first locking element, and the first locking element may be adapted to removably engage with a locking element of a head piece. Preferably, the head piece is adapted for removably receiving a tool piece.

Furthermore, a head piece for a torque wrench is provided, the head piece having a hollow head body with a first end and a second end, wherein the head body has a first bore extending from a first opening at the first end along a first axis and being adapted to accommodate a part of a handle. Further, the head body may have a second bore extending from a second opening along a second axis and being adapted to accommodate a tool piece.

Further, a torque wrench is provided, comprising a handle as described herein and a head piece that is adapted for removably engagement with the handle and adapted for removably receiving a tool piece. In an embodiment of the present invention, the torque wrench comprises a head piece as described herein.

The elongated body element of the handle has a first end and a second end.

Furthermore, the torque arm has a distal end, and the torque arm may be a substantially straight torque arm. In a preferred embodiment, the torque arm extends along and/or parallel to the first axis in an unloaded state. Preferably, the distal end of the torque arm extends beyond the first end of the body element, e.g. around 1.5 cm beyond the first end of the body element, thereby enabling a user of the torque wrench to hold and apply torque to the torque arm independently of the body element.

The first locking element of the handle may comprise a first locking arm, e.g. a straight first locking arm, extending in the first direction. The first locking arm has a proximal end and a distal end. The first locking arm may be resilient and/or resiliently attached to the body element, e.g. at its proximal end via a joint. The first locking element may comprise an engagement element, e.g. in the form of a protrusion and/or a recess. Further, the engagement element may be positioned at the distal end of the locking arm. The engagement element may be formed as a protrusion and/or a recess, and may be adapted for engagement with corresponding engagement element, e.g. recess and/or protrusion, of a head piece. The locking arm may be resilient in a direction substantially perpendicular to the first axis for provision of a snap fit clutch between the handle and the head piece.

In a preferred embodiment of the present invention, the first locking element and the body element are manufactured of one and the same blank.

In an embodiment of the handle according to the present invention, the first locking element comprises a threading to engage with corresponding threading of a head piece.

The first locking element may in an embodiment form a part of a bayonet clutch. A protrusion on and/or a recess in the body element may constitute the first locking element or form a part of the first locking element.

Preferably, the handle comprises a ratchet element that is adapted to engage with a tool piece in a ratchet device or a ratchet gear. The ratchet element may be an elongated ratchet element having a proximal end and a distal end. Preferably, the ratchet element extends along the first axis, and the ratchet element may be attached at its proximal end to the body element via a first joint. The first joint may be a resilient joint, such as a Charnier hinge, whereby the ratchet element is resiliently coupled to the body element. Preferably, the distal end of the ratchet element extends beyond the second end of the body element, e.g. around 1.5 mm beyond the second end of the body element, thereby enabling the distal end of the ratchet element to engage in a ratchet gear with a tool mounted in the head piece.

In a preferred embodiment of the present invention, the ratchet element and the body element are manufactured from one and the same blank.

During use of the torque wrench, a large force is applied to the ratchet element along the first axis when the ratchet element is engaged with a tool piece. If a sufficiently high force is applied to the ratchet element, the locking element of the handle may be forced out of engagement with a locking element of a head piece and thus cause a separation of the handle and the head piece. Accordingly, it may be desired to prevent separation of the handle and the head piece when the torque wrench is loaded.

In order to improve the function of the locking mechanism, the handle may comprise a support element that is arranged in such a way that the first locking element is supported in locking position, i.e. securely engaged with a locking element of the head piece, when the ratchet element is loaded, i.e. when the handle is rotated in engaging direction.

Preferably, the support element projects from the ratchet element close to or at the distal end of the ratchet element.

When the ratchet element is resiliently coupled to the body element of the handle there is a risk of permanently bending or breaking off the ratchet element. To avoid damage and excessive movement of the ratchet element a stop element is provided, the stop element being adapted to prevent unintended movement of the ratchet element. In a preferred embodiment, the stop element is attached to the body element and extends through an opening in the ratchet element. Preferably, the stop element is a pin with a head that is configured to stop the ratchet element from unintended movement in relation to the body element.

Furthermore, the handle may comprise a first guide element that is adapted to engage with a guide element of a head piece. Preferably, the first guide element is a guide pin mounted in a bore of the body element, the pin being adapted to engage with a corresponding recess in the head piece. In combination, or as an alternative, a recess may be provided to engage with a corresponding protrusion in the head piece. Guide elements of the handle and the head piece ensure and assist in correct assembly of the torque wrench.

The first guide element, such as a guide pin, may be mounted in an opening or a bore of the torque arm or the body element, e.g. by welding, gluing, mechanical press fit, or other suitable means.

The torque wrench of the present invention enables a user to apply a specific readable torque to prosthetic fixing elements, such as a screw, a bolt, and the like, and/or implants, that are to be implanted in or used during implantation on a patient. The torque arm may be a flexible and resilient torque arm. As an alternative or in combination, the torque arm may in an embodiment be resiliently attached to the body element at its proximal end, e.g. via a second joint also denoted as a torque arm joint. Thereby, the torque arm of the handle may be moved in relation to the body element extending along the first axis when torque is applied to the torque arm. The relative movement of the torque arm in relation to the first axis and the body element indicates the magnitude of the torque applied.

Preferably, the properties of the torque arm, e.g. length, thickness, and material, are chosen such as to obtain a suitable resilience. In an embodiment of the present invention, the properties of the torque arm are selected such that a substantially straight part of the torque arm bends away from the first axis in an angle from about 15° to about 20° at a torque of about 40 Ncm.

In an embodiment, the properties of the torque arm are chosen such that a torque of up to around 100 Ncm, e.g. up to around 70 Ncm, and/or up to around 40 Ncm, can be measured.

In an embodiment of the present invention, the distance between the torque arm and the body element is about 15 mm at the scale element with a load of about 40 Ncm.

In a preferred embodiment of the present invention, the torque arm and the body element are manufactured from one and the same blank.

It may be desirable to be able to determine the torque that is applied to an implant and/or a prosthetic fixing element, e.g. a screw, a bolt, and the like, during fixation, i.e. the torque that is applied to the torque wrench. Accordingly, the handle may comprise a scale element having a scale. Preferably, the scale element is attached to the torque arm, e.g. on the portion of the torque arm extending beyond the second end of the body element. The scale element may be mounted on the torque arm or on the body element. In an embodiment of the present invention, the scale element is mounted in an opening or a bore of the torque arm or the body element, e.g. by welding, gluing, threading, mechanical press fit, or other suitable means.

In a preferred embodiment of the present invention, the body element, the torque arm, the ratchet element, and the first locking element are formed from one and the same blank of the same material, such as metal.

Manufacture of the body element, the torque arm, the ratchet element, and the first locking element from one blank, e.g. a cylindrical member, has the advantage of reduced material waste and fewer manual working procedures during manufacture.

Preferably, the body element, the torque arm, the ratchet element, and/or the first locking element are made of titanium or of an alloy comprising titanium, such as Titanium Grade 3, Titanium Grade 4, Titanium Grade 5, Titanium Grade 6, and/or Titanium Grade 7. In a preferred embodiment of the present invention, the body element, the torque arm, the ratchet element, and/or the first locking element are made of Titanium Grade 5. In combination and/or as an alternative other metals or alloys, such as stainless steel, may be employed. Examples of alloys, which are to be regarded as non-limiting, are stainless steel of types 4C27A, 1RK91, AISI 304, AISI 316, and Sandvik SS 1802.

In an embodiment of the present invention, the handle or parts of the handle may be made of plastic material, e.g. comprising a polymer or mixtures thereof, or of a composite material, e.g. comprising one or more polymer materials.

Preferably, the ratchet element is adapted to engage with a tool ratchet element of a tool inserted in the head piece in such a way that a ratchet gear or ratchet function is provided.

The ratchet element may form a part of the head piece.

In the head piece according to the present invention, the second bore preferably extends from the second opening to a third opening in the head body.

Preferably, the first bore has a substantially circular cross section perpendicular to the first axis. Cross sections of other shapes such as oval, triangular, rectangular, quadratic may also be employed. Non-circular cross sections may render a guide element in the head piece and/or in the handle superfluous.

Preferably, the second bore has a substantially circular cross section perpendicular to the second axis such that a tool can be rotatably inserted in the second bore. Cross sections of other shapes such as oval, triangular, rectangular, quadratic may also be employed.

In a preferred embodiment of the head piece according to the invention, the first axis and the second axis are perpendicular, and/or are in the same plane. Further, the first bore, in a preferred embodiment of the head piece, communicates with the second bore. Preferably, the first bore communicates with the second bore in such a way that the ratchet element of a handle that is inserted into the first bore extends slightly into the second bore when the handle and the head piece are engaged, thereby allowing the ratchet element to form a ratchet gear when engaging with a tool ratchet element of a tool removably inserted in the second bore. The ratchet gear provides one way rotation of the tool around the second axis.

The head body may comprise a second locking element also denoted as a handle locking element that is adapted to removably engage with a locking element of a handle. Preferably, the second locking element is formed on an inner surface of the head body, e.g. on a first inner surface defining the first bore. Preferably, the second locking element is adapted to engage with a corresponding first locking element of the handle. The second locking element may comprise an engagement element, e.g. in the form of a recess in and/or a protrusion on the first inner surface of the head body. In a preferred embodiment of the head piece, the second locking element is formed as an annular recess in the first inner surface. An opening in the head body may form the second locking element.

In an embodiment of the head piece, a slit in the head body, e.g. an L-shaped silt extending from the first end of the head body, may form the second locking element, e.g. for forming a part of a bayonet clutch.

The head piece may further comprise a fourth opening also denoted as a release opening in the head body. The fourth opening may provide access to the first bore. Thus, a user may be enabled to activate or release a locking element of the handle of the torque wrench, thereby enabling a user to easily separate the handle and the head piece, i.e. release the head piece from the handle.

Furthermore, the head piece may comprise a second guide element that is adapted to engage with a guide element of a handle. Preferably, the second guide element is a recess or slit at the first end of the head piece, the recess or slit being adapted to engage with a corresponding guide pin of the handle. In combination, or as an alternative, a protrusion may be provided, e.g. on the first inner surface of the head piece, to engage with a corresponding recess or slit in the handle.

The head piece may comprise a tubular portion having a wall defining at least a part of the first bore and having the first opening at the first end of the head piece. The wall of the tubular portion may comprise the fourth opening.

Preferably, the head piece is made from one blank.

Preferably, the head piece is made of metal, such as copper, nickel, molybdenum, titanium, or aluminum or alloys thereof. In a preferred embodiment, the head piece is made of stainless steel, such as stainless steel of types 4C27A, 1RK91, AISI 304, AISI 316, and/or Sandvik SS 1802.

In an embodiment of the present invention, the head piece may be made of plastic material, e.g. comprising a polymer or mixtures thereof, or of a composite material, e.g. comprising one or more polymer materials. The head piece may be made from injection molding.

Typically, different tools, e.g. from different manufacturers, have different dimensions, such as the radius of the tool, the size and number of ratchet elements on a tool, such as teeth on the tool, the ratchet elements engaging with the ratchet element of the torque wrench to form a ratchet gear, and the like. Accordingly, the dimensions of a head piece, in particular the dimensions of the second bore, may be adapted to a specific tool, It is an important advantage of the present invention that head pieces, which are relatively cheap, can be easily replaced to allow a user to use tools of different dimensions. The costs of a head piece are low compared to the costs of the handle, which enables the user to use tools with different dimensions at a relatively low cost.

It is an important advantage that the greater part of the handle and the head piece can be manufactured in one piece, thus requiring limited manual handling during manufacture.

Figure 2:
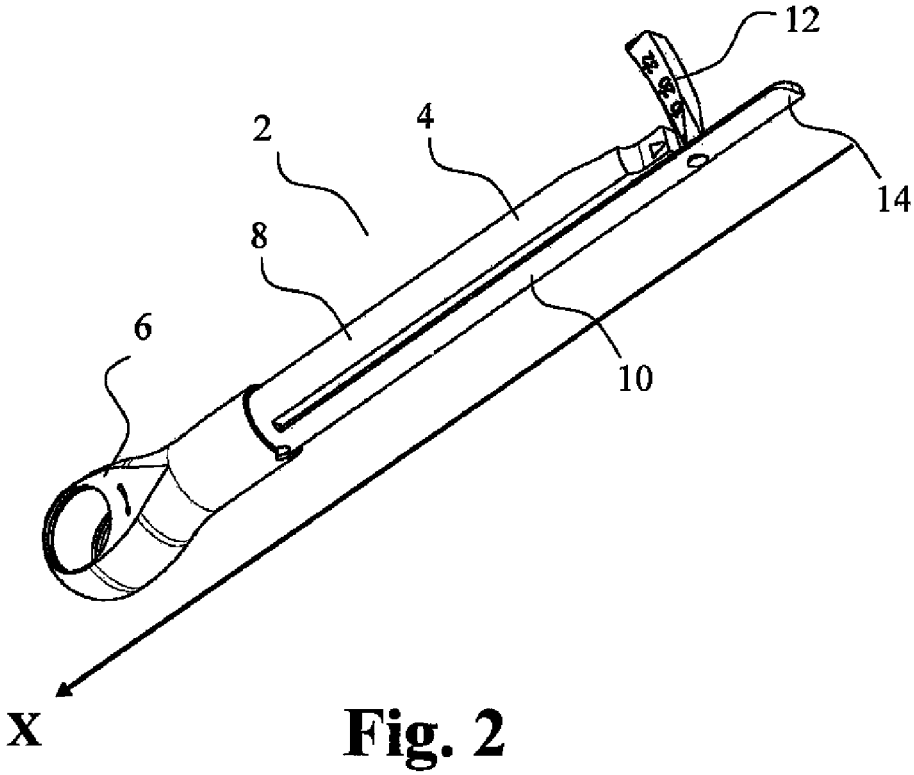
Figure 3:
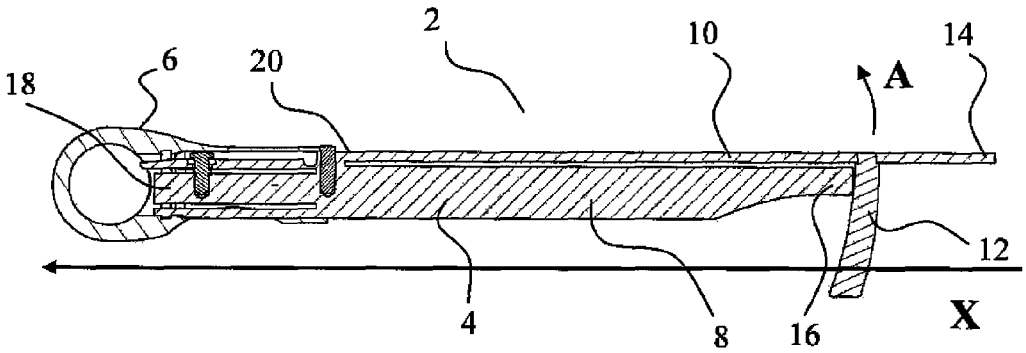
Figure 4:
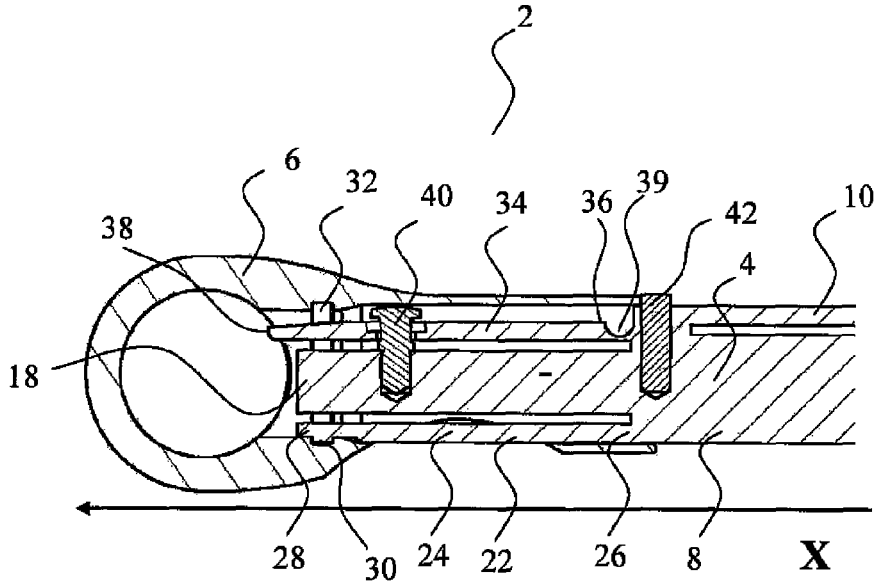
Figure 5:
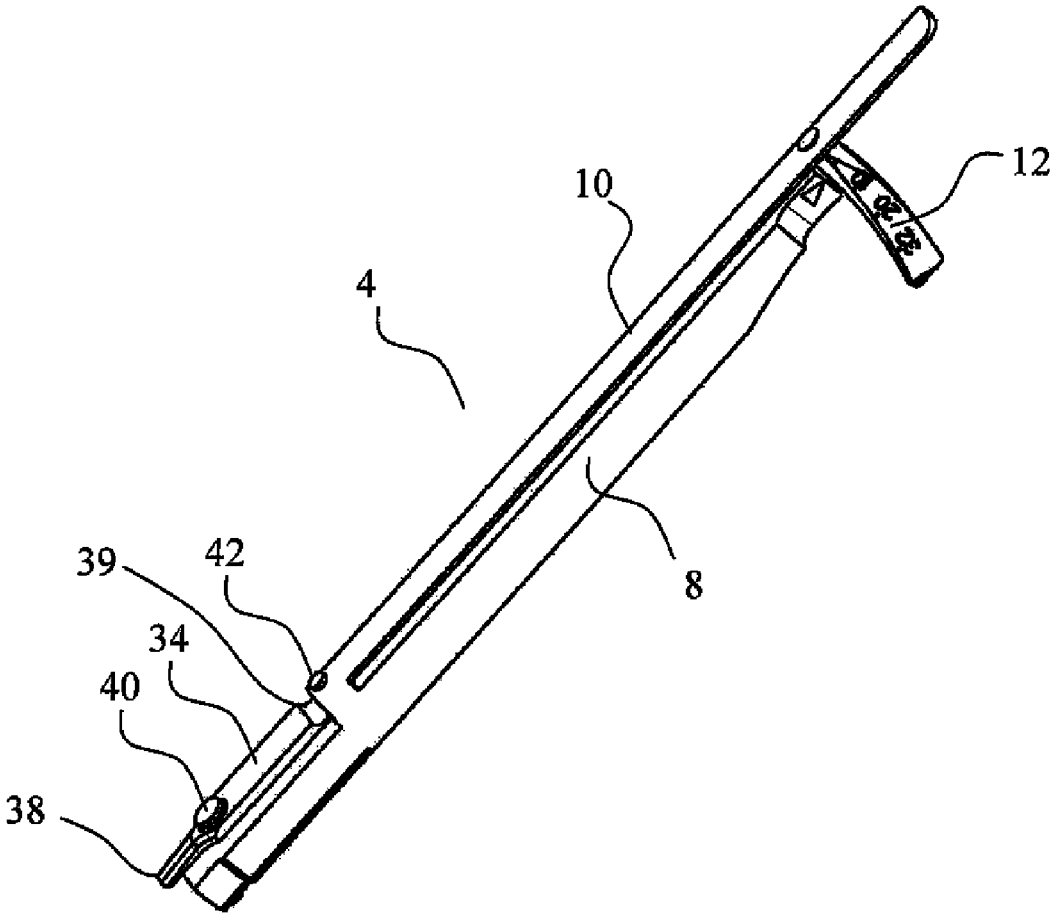
Figure 6:
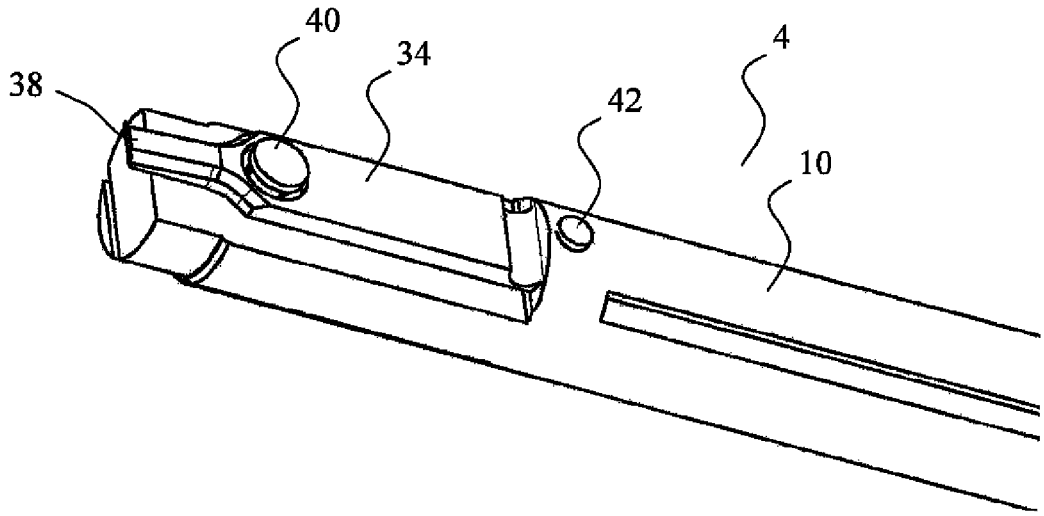
Figure 7:
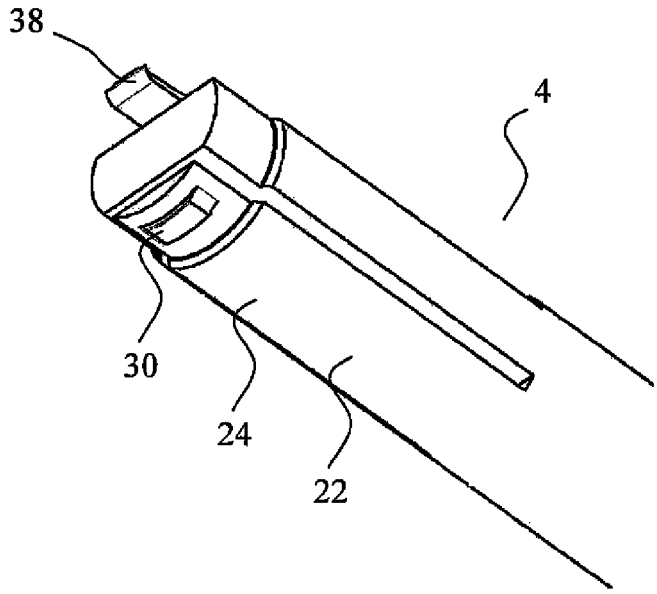
Figure 8:
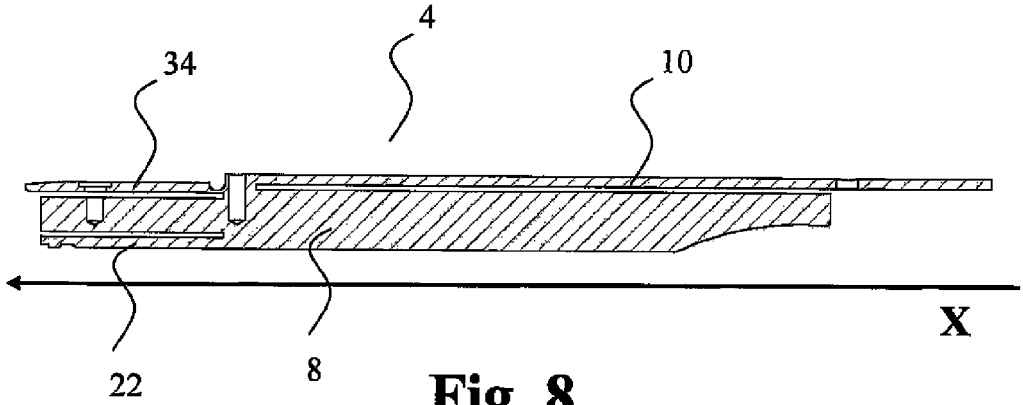
Figure 9:
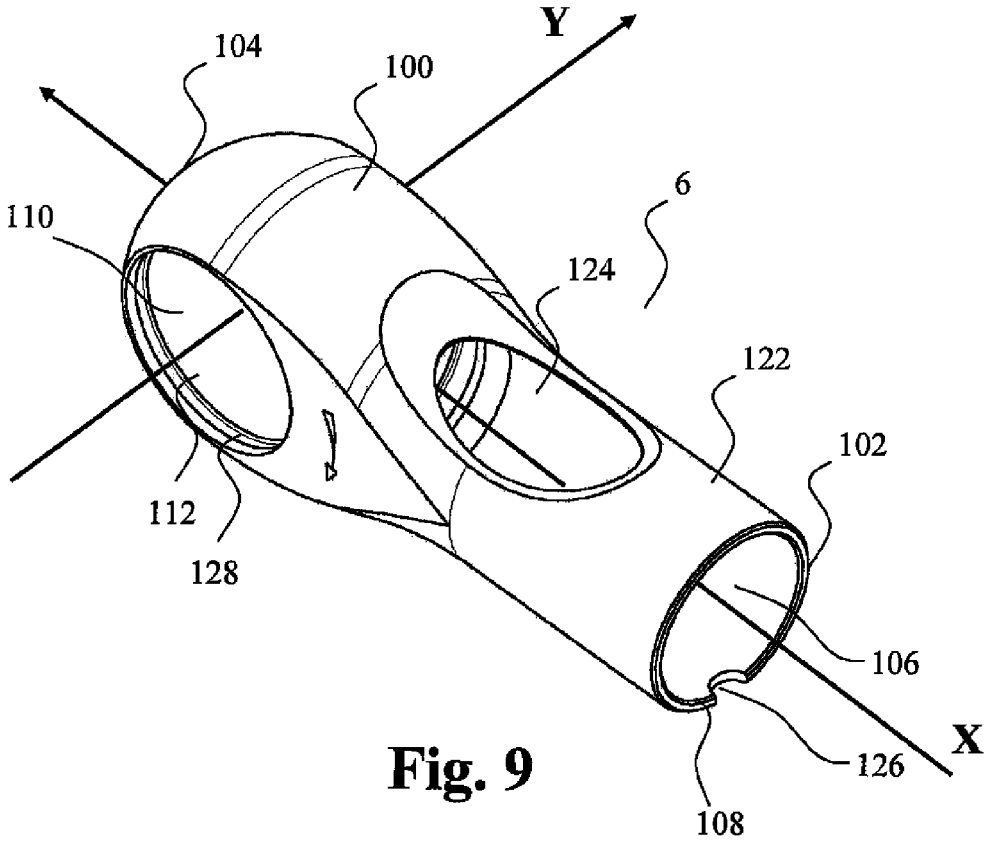
Figure 10:
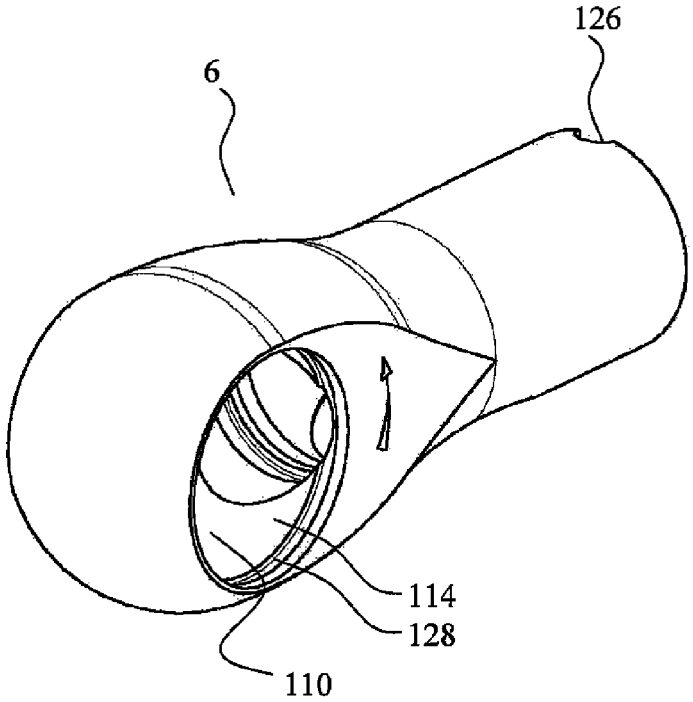
Figure 11:
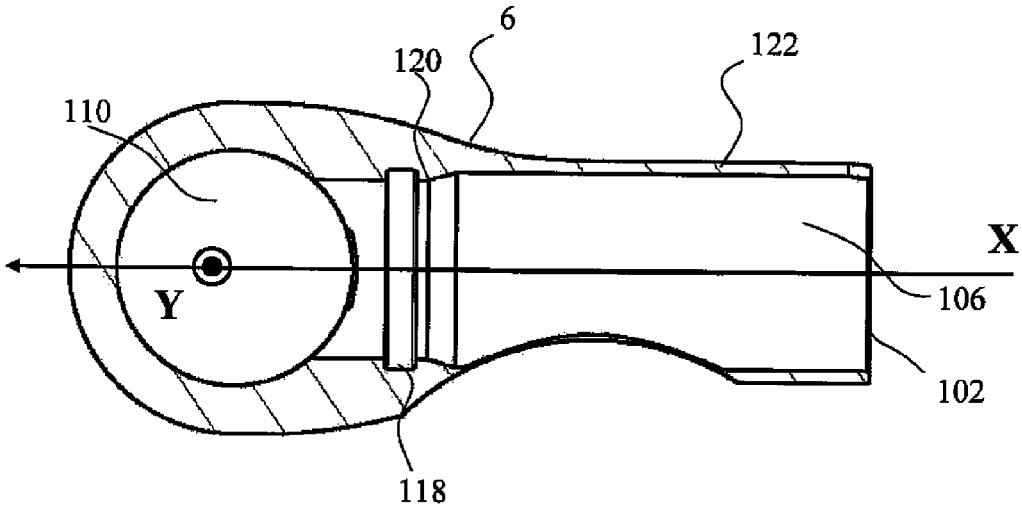
Figure 12:
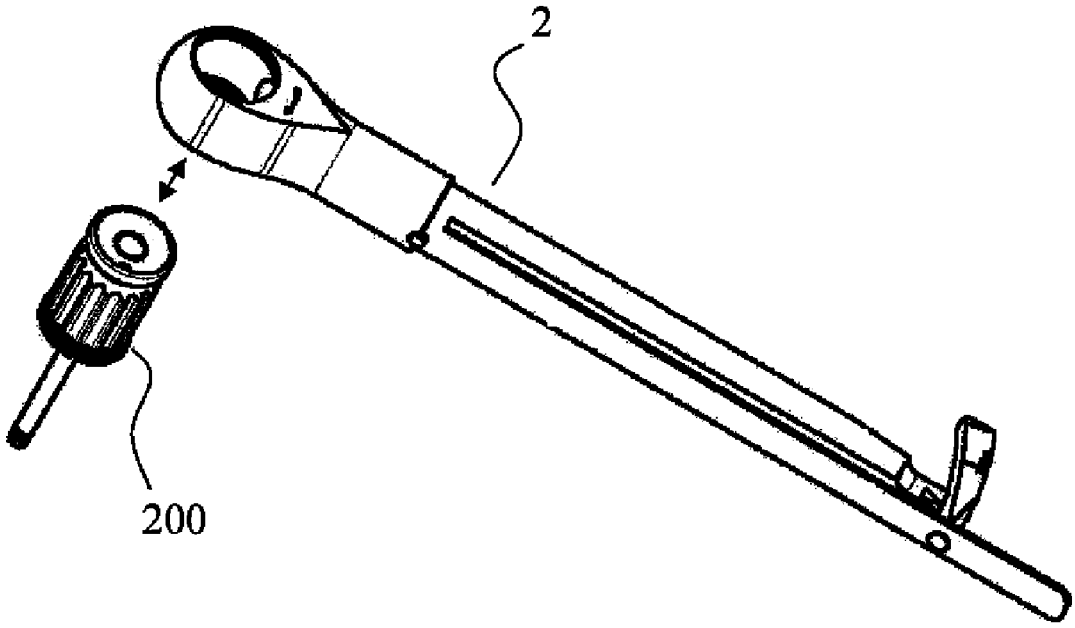
Figure 13:
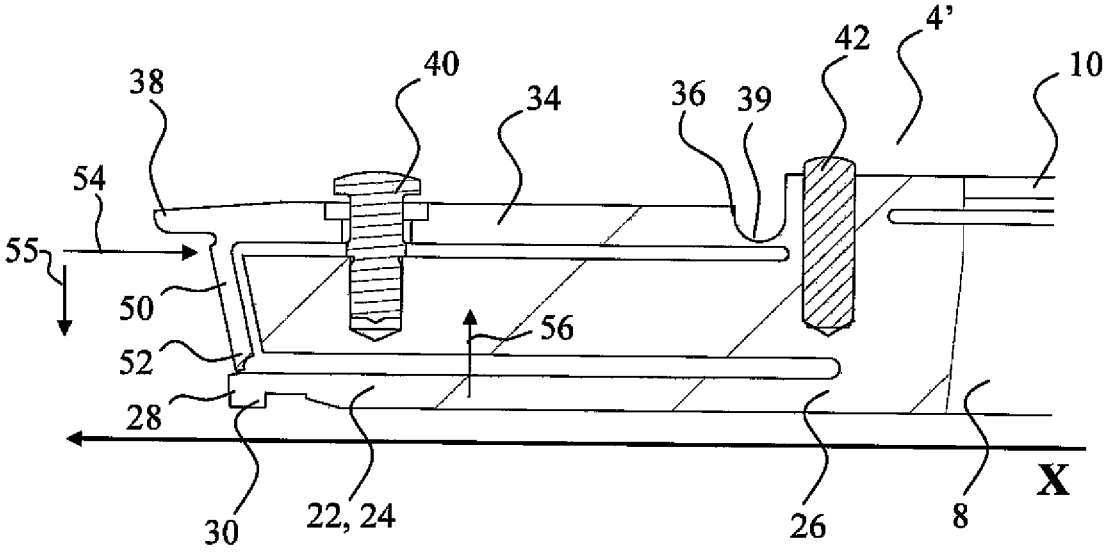

The present invention will now be described in more detail with reference to the accompanying drawings, wherein FIG. 1 shows a perspective view of an embodiment of a torque wrench according to the invention, FIG. 2 shows another perspective view of the torque wrench of FIG. 1, FIG. 3 shows a cross section of the torque wrench of FIG. 1, FIG. 4 shows in more detail a cross sectional part of the torque wrench of FIG. 1, FIG. 5 shows a perspective view of an embodiment of a handle according to the invention, FIG. 6 is an enlarged perspective view of a handle part of the handle of FIG. 5, FIG. 7 is another enlarged perspective view of a handle part of the handle of FIG. 5, FIG. 8 shows a cross section of a part of the handle illustrated in FIG. 5, FIG. 9 is a perspective view of an embodiment of the head piece according to the invention, FIG. 10 is another perspective view of the head piece illustrated in FIG. 9, FIG. 11 is a cross section of the head piece illustrated in FIG. 9, FIG. 12 shows an embodiment of the torque wrench according to the present invention and a tool piece, and FIG. 13 shows a cross section of an embodiment of the handle according to the invention.

In the following description, a preferred embodiment of the present invention will be described referring to the drawings, where like reference numbers refer to like features of the present invention.

FIGS. 1 and 2 are different perspective views of an embodiment of a torque wrench according to the invention. The torque wrench 2 comprises a handle 4, 4' and a head piece 6 that are removably coupled to each other. The handle 4, 4' comprises an elongated body element 8 and a resilient torque arm 10 with a scale element 12. The scale element 12 is attached to the torque arm 10 near the distal end 14 of the torque arm 10 and comprises a scale for indicating the torque applied to the torque arm during use. The body element 8 and the torque arm 10 extend in a direction parallel to a first axis X.

FIG. 3 shows a cross section of the torque wrench 2 illustrated in FIGS. 1 and 2. The body element 8 of the handle 4 has a first end 16 and a second end 18. The proximal end 20 of the torque arm 10 may be attached to the body element by any suitable means, e.g. by welding, gluing, and/or by mechanical fit, such as threaded surfaces or press fit, and the like. In the illustrated embodiment, the body element 8 and the torque arm 10 are made from one blank forming a body element 8 and a torque arm in one piece.

During use of the torque wrench, the user has to apply a certain amount of torque to the handle in order to fasten a prosthetic element, such as a screw. During fastening or adjustment, the distal end 14 of the torque arm 10 is loaded in the direction indicated by the arrow A. Due to the resistance from the prosthetic element, the torque arm 10 bends in relation to the body element 8 extending along the first axis X. An arrow at the first end 16 of the body element indicates the size of the applied torque on the scale of the scale element 12. When the load on the torque arm 10 is removed, the torque arm 10 returns to its initial position parallel to the first axis.

FIG. 4 shows a more detailed cross section of a part of the torque wrench 2. The handle 4 of the torque wrench 2 comprises a first locking element 22 being adapted to engage with a locking element of a head piece in such a way that the handle 4 and the head piece 6 are removably connected. The first locking element 22 comprises a first locking arm 24 having a proximal end 26 and a distal end 28. In the illustrated embodiment, the first locking arm 24 is a resilient and straight arm extending parallel to the first axis X. Furthermore, the first locking element 22 has an engagement element formed as a protrusion 30 extending perpendicularly to the first axis near the distal end 28. The protrusion 30 is adapted to engage with a second locking element comprising an engagement element in the form of an annular recess 32 on the first inner surface of the head piece 6 in a snap fit clutch such as to enable easy assembly and disassembly of the handle and the head piece.

In the illustrated embodiment, the body element 8 and the first locking element 22 are made from one blank forming the body element 8 and the first locking element in one piece.

Furthermore, the handle 4 comprises a ratchet element 34 that is adapted to engage with a tool piece in a ratchet device or a ratchet gear. The ratchet element 34 is a straight ratchet element extending parallel to the first axis and having a proximal end 36 and a distal end 38. The ratchet element 34 is attached at its proximal end 36 to the body element 8 via a resilient first joint 39 in the form as a Charnier Hinge, whereby the ratchet element 34 is resiliently coupled to the body element 8. The distal end 38 of the ratchet element 34 extends about 1.5 mm beyond the second end 18 of the body element thereby enabling the distal 38 end of the ratchet element 34 to engage in a ratchet gear with a tool removably mounted in the head piece 6.

In the illustrated embodiment, the body element 8 and the ratchet element 34 are made from one blank forming the body element 8 and the ratchet element 34 in one piece.

Further, the handle 4 comprises a stop element 40 that prevents damage of the first joint 39 by limiting movement of the ratchet element 34. The stop element 40 is adapted to prevent the ratchet element 34 from permanently bending or breaking off the handle 4. The stop element 40 has a pin with a head, the stop element being attached to the body element by a mechanical press fit of the pin in a bore of the body element 8. Other suitable means such as welding, gluing, and/or threaded surfaces may be employed. The pin extends through an opening in the ratchet element and the head of the stop element 40 is configured to limit the movement of the ratchet element 34 in relation to the body element 8.

Furthermore, the handle 4 comprises an optional first guide element 42 that is adapted to engage with a guide element of a head piece, e.g. the head piece 6. In the illustrated embodiment, the first guide element 42 is a guide pin mounted in a bore of the body element by mechanical press fit, the guide pin being adapted to engage with a corresponding recess in the head piece. Guide elements of the handle and the head piece ensure and assist in correct assembly of the torque wrench according to the present invention.

The first guide element may be mounted on the handle by welding, gluing, mechanical press fit, threaded surfaces or other suitable means.

FIGS. 5-7 show perspective views of the handle and a part of the handle 4 according to the present invention.

FIG. 8 is a cross section of the handle 4 showing the body element 8, the torque arm 10, the ratchet element 34, and the first locking element 22 made from one blank. The stop element, the first guide element, and the scale element are not shown.

FIGS. 9-10 show perspective views of an embodiment of a head piece 6 according to the invention. The head piece 6 has a hollow head body 100 with a first end 102 and a second end 104, wherein the body has a first bore 106 with a substantially circular cross section in a plan perpendicular to the first axis X and extending from a first opening 108 at the first end 102 along a first axis X and being adapted to accommodate a part of a handle, e.g. a part of the handle 4. The first bore may have a suitable diameter, such as from about 5 mm to about 12 mm. In the illustrated embodiment, the first bore 106 has a diameter of about 7 mm. The head piece also has a second bore 110 extending from a second opening 112 along a second axis Y and being adapted to accommodate a tool piece. In the illustrated embodiment, the first axis X and the second axis Y are perpendicular and are positioned in the same plane. The second bore extends from the second opening 112 to a third opening 114 in the head body and having a diameter of from 5-10 mm, preferably about 8.5 mm. A tool piece may be inserted into the head piece through the second opening or through the third opening depending on desired engagement direction of the ratchet gear.

The second bore has a substantially circular cross section perpendicular to the second axis such that a tool can be inserted in the second bore and rotate around the second axis.

The first bore 106 communicates with the second bore 110 in such a way that the ratchet element 34 of a handle 4 that is inserted into the first bore 106 extends slightly into the second bore 110 when the handle 4 and the head piece 6 are engaged, thereby allowing the ratchet element to form a ratchet gear when engaging with a tool ratchet element of a tool removably inserted in the second bore. The ratchet gear provides one way rotation of the tool around the second axis.

FIG. 11 shows a cross section of the head piece 6. The head piece 6 comprises a second locking element that is adapted to removably engage with a locking element of a handle. The second locking element is formed on a first inner surface defining the first bore 106 and being adapted to engage with a corresponding first locking element of the handle. The second locking element comprises an engagement element in the form of an annular recess 118 on the first inner surface of the head body. Furthermore, the first inner surface defining the first bore is tapered, i.e. has an annular protrusion 120. Thereby the resilient first locking arm of the handle is forced radially inwards when the handle and the head piece are assembled. When the protrusion 30 has passed the annular protrusion 120, the protrusion 30 engages with the recess 118 due to the resilient first locking arm returning to its initial position thereby providing a snap fit clutch between the handle and the head piece.

Further, the head piece comprises a tubular portion having a wall 122 defining a part of the first bore. The wall 122 comprises a fourth opening 124 enabling a user to release the head piece from the handle by accessing and pressing the resilient first locking arm inwards through the fourth opening 124 in the head piece. Thereby a user is enabled to easily separate the handle and the head piece, i.e. release the head piece from the handle.

Furthermore, the head piece comprises a second guide element in the form of a recess or slit 126 that is adapted to engage with a guide element of a handle.

Recesses 128 are provided in the second inner surface of the head body 100 near the second opening 112 and the third opening 114, respectively to provide engagement means for removably inserting a tool piece in the second bore.

In the illustrated embodiment, the head piece 6 is made from one and the same blank in stainless steel type AISI 304.

FIG. 12 shows an embodiment of a torque wrench 2 according to the invention, adapted to removably engage with a tool piece 200 as indicated by the double arrow.

FIG. 13 illustrates an embodiment of the handle according to the present invention. The handle 4' comprises a first locking element 22 being adapted to engage with a locking element of a head piece in such a way that the handle 4' can be removably connected to a head piece. The first locking element 22 comprises a resilient, straight first locking arm 24 having a proximal end 26 and a distal end 28 and extending parallel to the first axis X. Furthermore, the first locking element 22 has an engagement element formed as a protrusion 30 extending perpendicularly to the first axis near the distal end 28. The protrusion 30 is adapted to engage with a second locking element comprising an engagement element in the form of a recess on an inner surface of a head piece in a snap fit clutch such as to enable easy assembly and disassembly of the handle and the head piece.

Furthermore, the handle 4' comprises a ratchet element 34 that is adapted to engage with a tool piece in a ratchet device or a ratchet gear. The ratchet element 34 is a straight ratchet element extending parallel to the first axis X and having a proximal end 36 and a distal end 38. The ratchet element 34 is attached at its proximal end 36 to the body element 8 via a resilient first joint 39 in the form as a Charnier Hinge, whereby the ratchet element 34 is resiliently coupled to the body element 8.

A support element 50 is provided near the distal end 38 of the ratchet element 34. The support element 50 projects from the ratchet element 34 and is arranged such that the distal end 52 of the support element 50 is close to or in contact with the locking arm 24. When the ratchet element 34 is loaded due to engagement with a head piece in engaging direction, a force is applied to distal end 38 of the ratchet element. The applied force has a first component in the direction indicated by the arrow 54 parallel to the first axis and a second component in the direction indicated by the arrow 55 perpendicular to the first axis. Typically, the first component is larger than the second component, however the relationship between the first and second component may vary, e.g. depending on tolerances and the form of the teeth on the tool piece. In an embodiment of the present invention the first component is about three times larger than the second component.

The locking mechanism is improved in that the second component of the applied force via the support element 50 is applied to the locking arm 24, thereby contributing to improve the strength of the locking mechanism when the handle is in engagement with a tool piece inserted in the head piece. Accordingly, a small disengagement force has to be applied to disassemble the handle and a head piece when the handle is to be disassembled by the operator, and a large disengagement force is needed to disengage the handle and head piece during use. Thus, the risk of unintended separation or disengagement of the handle and a head piece during use is reduced, while maintaining high user friendliness for intended disassembly.

The support element 50 substantially supports the locking arm 24 in the locking position, i.e. prevents movement of the locking arm 24 in the direction indicated by arrow 56 which could lead to disengagement of the handle and the head piece. Thereby, the engagement element 30 of the locking element 22 is supported in the locking position and is not forced out of engagement with a corresponding engagement element of a head piece. Thus, the support element 50 provides improved strength of the snap fit clutch during a load condition of the wrench. During a load condition, the distal end 52 of the support element 50 may contact the locking arm at the distal end 28. During disassembly, the support element 50 is easily moved with the locking arm 24 in the direction indicated by arrow 56 due to the resilient joint 39, and thus user-friendliness regarding disassembly of the wrench is not affected. Accordingly, the support element provides an improved locking mechanism without reducing user-friendliness of the wrench.

The invention claimed is:

1. A handle for a wrench, comprising an elongated body element extending along a first axis, and a torque arm for indicating the torque applied to the torque arm, the torque arm having a proximal end attached to the body element, the handle further comprising a first locking element, the first locking element being adapted to removably engage with a locking element of a head piece, and wherein the handle comprises a ratchet element that is adapted to engage with a tool piece in a ratchet gear.

2. A handle according to claim 1, wherein the first locking element comprises a first locking arm extending along the first axis.

3. A handle according to claim 1, wherein the handle comprises a support element that is arranged in such a way that the first locking element is supported in locking position, when the ratchet element is loaded in the direction of the first axis.

4. A handle according to claim 1, wherein the ratchet element extends along the first axis.

5. A handle according to claim 1, wherein the ratchet element is attached to the body element via a first joint.

6. A handle according to claim 1, wherein the handle comprises a stop element attached to the body element and being adapted to prevent unintended movement of the ratchet element.

7. A handle according to claim 1, wherein the handle comprises a first guide element that is adapted to engage with a guide element of a head piece.

8. A handle according to claim 1, wherein the handle comprises a scale element having a scale.

9. A handle according to claim 1, wherein at least a part of the torque arm is resilient.

10. A handle according to claim 1, wherein the proximal end of the torque arm is connected to the body element via a torque arm joint.

11. A handle according to claim 10, wherein the torque arm joint is a resilient joint.

12. A handle according to claim 1, wherein the body element and the torque arm is made from one blank.

13. A handle according to claim 1, wherein the body element and the torque arm forms one blank.

14. A handle according to claim 1, wherein the body element and the torque arm are made of metal, preferably titanium or stainless steel.

15. A torque wrench comprising a handle according to claim 1 and a head piece that is adapted for removably engagement with the handle and adapted for removably receiving a tool piece.

16. A torque wrench comprising the handle according to claim 1 and a head piece, the head piece having a hollow head body with a first end and a second end, wherein the head body has a first bore extending from a first opening at the first end along a first axis and being adapted to accommodate a part of the handle, and a second bore extending from a second opening along a second axis and being adapted to accommodate the tool piece.

17. A head piece for a torque wrench, having a hollow head body with a first end and a second end, wherein the head body has a first bore extending from a first opening at the first end along a first axis and being adapted to accommodate a part of a handle, and a second bore extending from a second opening along a second axis and being adapted to accommodate a tool piece, and wherein a release opening in the head body communicates with the first bore.

18. A head piece according to claim 17, wherein the second bore extends from the second opening to a third opening in the head body.

19. A head piece according to claim 17, wherein the first axis and the second axis are perpendicular.

20. A head piece according to claim 17, wherein the first axis and the second axis are in the same plane.

21. A head piece according to claim 17, wherein the first bore communicates with the second bore.

22. A head piece according to claim 17, wherein the head body comprises a handle locking element adapted to removably engage with a locking element of a handle.

23. A head piece according to claim 22, wherein the handle locking element is formed as a recess in a first inner surface of the head body.

* * * * *